US008650775B2

(12) United States Patent
Peyton

(10) Patent No.: US 8,650,775 B2
(45) Date of Patent: Feb. 18, 2014

(54) ARTICLE OF FOOTWEAR HAVING A SOLE STRUCTURE WITH PERIMETER AND CENTRAL ELEMENTS

(75) Inventor: Lee Donald Peyton, Oregon City, OR (US)

(73) Assignee: Nike, Inc., Beaverton, OR (US)

( * ) Notice: Subject to any disclaimer, the term of this patent is extended or adjusted under 35 U.S.C. 154(b) by 831 days.

(21) Appl. No.: 12/491,973

(22) Filed: Jun. 25, 2009

(65) Prior Publication Data

US 2010/0325914 A1 Dec. 30, 2010

(51) Int. Cl.
*A43B 13/20* (2006.01)
*A43B 21/32* (2006.01)

(52) U.S. Cl.
USPC ..... 36/29; 36/28; 36/35 B

(58) Field of Classification Search
USPC ..... 36/28, 29, 103, 35 R, 37, 31, 25 R, 34 R
See application file for complete search history.

(56) References Cited

U.S. PATENT DOCUMENTS

| | | | |
|---|---|---|---|
| 2,677,906 | A | 5/1954 | Reed |
| 2,703,770 | A | 3/1955 | Melzer |
| 3,030,640 | A | 4/1962 | Gosman |
| 3,608,215 | A | 9/1971 | Fukuoka |
| 3,685,176 | A | 8/1972 | Rudy |
| 3,758,964 | A | 9/1973 | Nishimura |
| 4,187,620 | A | 2/1980 | Selner |
| 4,217,705 | A | 8/1980 | Donzis |
| 4,358,902 | A | 11/1982 | Cole et al. |
| 4,506,460 | A | 3/1985 | Rudy |
| 4,547,919 | A | 10/1985 | Wang |
| 4,698,864 | A | 10/1987 | Graebe |
| 4,722,131 | A | 2/1988 | Huang |
| 4,782,602 | A | 11/1988 | Lakic |
| 4,803,029 | A | 2/1989 | Iversen et al. |
| 4,817,304 | A | 4/1989 | Parker et al. |
| 4,823,482 | A | 4/1989 | Lakic |
| 4,845,861 | A | 7/1989 | Moumdjian |
| 4,874,640 | A | 10/1989 | Donzis |
| 4,891,855 | A | 1/1990 | Cheng-Chung |
| 4,906,502 | A | 3/1990 | Rudy |
| 4,912,861 | A | 4/1990 | Huang |
| 4,991,317 | A | 2/1991 | Lakic |
| 4,999,931 | A | 3/1991 | Vermeulen |
| 5,022,109 | A | 6/1991 | Pekar |
| 5,025,575 | A | 6/1991 | Lakic |
| 5,042,176 | A | 8/1991 | Rudy |

(Continued)

OTHER PUBLICATIONS

International Search Report and Written Opinion in PCT Application No. PCT/US2010/039839, mailed on Feb. 24, 2011.

*Primary Examiner* — Jila M Mohandesi
(74) *Attorney, Agent, or Firm* — Plumsea Law Group, LLC

(57) ABSTRACT

A sole structure for an article of footwear may include a perimeter element and a central element, which may be fluid-filled chambers. The perimeter element extends adjacent to a sidewall of the sole structure, and the central element is centrally-positioned. A gap may extend between the central element and the perimeter element. The gap may have an upper portion and a lower portion, with the upper portion being located closer to the sidewall than the lower portion. The perimeter element may also have a first compressibility and the central element may have a second compressibility, with the first compressibility being less than the second compressibility. Also, the upper surface of the perimeter element may be at a greater elevation or higher than an upper surface of the central element.

25 Claims, 13 Drawing Sheets

(56) References Cited

U.S. PATENT DOCUMENTS

| | | | | |
|---|---|---|---|---|
| 5,044,030 | A | 9/1991 | Balaton | |
| 5,158,767 | A | 10/1992 | Cohen et al. | |
| 5,179,792 | A | 1/1993 | Brantingham | |
| 5,193,246 | A | 3/1993 | Huang | |
| 5,199,191 | A | 4/1993 | Moumdjian | |
| 5,224,277 | A | 7/1993 | Sang Do | |
| 5,224,278 | A | 7/1993 | Jeon | |
| 5,228,156 | A | 7/1993 | Wang | |
| 5,235,715 | A | 8/1993 | Donzis | |
| 5,245,766 | A | 9/1993 | Warren | |
| 5,253,435 | A | 10/1993 | Auger et al. | |
| 5,257,470 | A | 11/1993 | Auger et al. | |
| 5,313,717 | A * | 5/1994 | Allen et al. | 36/28 |
| 5,335,382 | A | 8/1994 | Huang | |
| 5,337,492 | A | 8/1994 | Anderie et al. | |
| 5,353,459 | A | 10/1994 | Potter et al. | |
| 5,367,791 | A | 11/1994 | Gross et al. | |
| 5,406,719 | A | 4/1995 | Potter | |
| 5,493,792 | A | 2/1996 | Bates et al. | |
| 5,572,804 | A | 11/1996 | Skaja et al. | |
| 5,592,706 | A | 1/1997 | Pearce | |
| 5,595,004 | A | 1/1997 | Lyden et al. | |
| 5,669,161 | A | 9/1997 | Huang | |
| 5,686,167 | A | 11/1997 | Rudy | |
| 5,704,137 | A | 1/1998 | Dean et al. | |
| 5,741,568 | A | 4/1998 | Rudy | |
| 5,771,606 | A | 6/1998 | Litchfield et al. | |
| 5,832,630 | A | 11/1998 | Potter | |
| 5,846,063 | A | 12/1998 | Lakic | |
| 5,907,911 | A | 6/1999 | Huang | |
| 5,916,664 | A | 6/1999 | Rudy | |
| 5,925,306 | A | 7/1999 | Huang | |
| 5,952,065 | A | 9/1999 | Mitchell et al. | |
| 5,976,451 | A | 11/1999 | Skaja et al. | |
| 5,979,078 | A | 11/1999 | McLaughlin | |
| 5,993,585 | A | 11/1999 | Goodwin et al. | |
| 6,009,637 | A | 1/2000 | Pavone | |
| 6,013,340 | A | 1/2000 | Bonk et al. | |
| 6,027,683 | A | 2/2000 | Huang | |
| 6,029,962 | A | 2/2000 | Shorten et al. | |
| 6,065,150 | A | 5/2000 | Huang | |
| 6,098,313 | A | 8/2000 | Skaja | |
| 6,127,010 | A | 10/2000 | Rudy | |
| 6,128,837 | A | 10/2000 | Huang | |
| 6,192,606 | B1 | 2/2001 | Pavone | |
| 6,253,466 | B1 | 7/2001 | Harmon-Weiss et al. | |
| 6,258,421 | B1 | 7/2001 | Potter | |
| 6,374,514 | B1 | 4/2002 | Swigart | |
| 6,385,864 | B1 | 5/2002 | Sell, Jr. et al. | |
| 6,402,879 | B1 | 6/2002 | Tawney et al. | |
| 6,430,843 | B1 | 8/2002 | Potter et al. | |
| 6,457,262 | B1 | 10/2002 | Swigart | |
| 6,463,612 | B1 | 10/2002 | Potter | |
| 6,550,085 | B2 | 4/2003 | Roux | |
| 6,571,490 | B2 | 6/2003 | Tawney et al. | |
| 6,665,958 | B2 | 12/2003 | Goodwin | |
| 6,783,184 | B2 | 8/2004 | DiBattista et al. | |
| 6,796,056 | B2 * | 9/2004 | Swigart | 36/29 |
| 6,837,951 | B2 | 1/2005 | Rapaport | |
| 6,892,477 | B2 | 5/2005 | Potter et al. | |
| 6,918,198 | B2 | 7/2005 | Chi | |
| 6,931,764 | B2 | 8/2005 | Swigart et al. | |
| 6,971,193 | B1 | 12/2005 | Potter et al. | |
| 7,000,335 | B2 | 2/2006 | Swigart et al. | |
| 7,020,988 | B1 * | 4/2006 | Holden et al. | 36/35 B |
| 7,051,456 | B2 | 5/2006 | Swigart et al. | |
| 7,070,845 | B2 | 7/2006 | Thomas et al. | |
| 7,076,891 | B2 | 7/2006 | Goodwin | |
| 7,086,179 | B2 | 8/2006 | Dojan et al. | |
| 7,128,796 | B2 | 10/2006 | Hensley et al. | |
| 7,131,218 | B2 | 11/2006 | Schindler | |
| 7,141,131 | B2 | 11/2006 | Foxen et al. | |
| 7,200,957 | B2 | 4/2007 | Hubbard et al. | |
| 7,244,483 | B2 | 7/2007 | Tawney et al. | |
| 7,278,226 | B2 * | 10/2007 | Holden et al. | 36/35 R |
| 7,451,554 | B2 | 11/2008 | Hazenberg et al. | |
| 7,475,498 | B2 * | 1/2009 | Litchfield et al. | 36/29 |
| 7,555,848 | B2 | 7/2009 | Aveni et al. | |
| 7,555,851 | B2 | 7/2009 | Hazenberg et al. | |
| 7,832,118 | B2 * | 11/2010 | Holden et al. | 36/35 R |

* cited by examiner

ARTICLE OF FOOTWEAR HAVING A SOLE STRUCTURE WITH PERIMETER AND CENTRAL ELEMENTS

BACKGROUND

Conventional articles of athletic footwear include two primary elements, an upper and a sole structure. The upper is generally formed from a plurality of elements (e.g., textiles, foam, leather, synthetic leather) that are stitched or adhesively bonded together to form an interior void for securely and comfortably receiving a foot. The sole structure incorporates multiple layers that are conventionally referred to as a sockliner, a midsole, and an outsole. The sockliner is a thin, compressible member located within the void of the upper and adjacent to a plantar (i.e., lower) surface of the foot to enhance comfort. The midsole is secured to the upper and forms a middle layer of the sole structure that attenuates ground reaction forces (i.e., imparts cushioning) during walking, running, or other ambulatory activities. The outsole forms a ground-contacting element of the footwear and is usually fashioned from a durable and wear-resistant rubber material that includes texturing to impart traction.

The primary material forming many conventional midsoles is a polymer foam, such as polyurethane or ethylvinylacetate. In some articles of footwear, the midsole may also incorporate a fluid-filled chamber that increases durability of the footwear and enhances ground reaction force attenuation of the sole structure. In some footwear configurations, the fluid-filled chamber may be at least partially encapsulated within the polymer foam, as in U.S. Pat. No. 5,755,001 to Potter, et al., U.S. Pat. No. 6,837,951 to Rapaport, and U.S. Pat. No. 7,132,032 to Tawney, et al. In other footwear configurations, the fluid-filled chamber may substantially replace the polymer foam, as in U.S. Pat. No. 7,086,180 to Dojan, et al. In general, the fluid-filled chambers are formed from a polymer material that is sealed and pressurized, but may also be substantially unpressurized or pressurized by an external source. In some configurations, textile or foam tensile members may be located within the chamber, or reinforcing structures may be bonded to an exterior surface of the chamber to impart shape to or retain an intended shape of the chamber.

Fluid-filled chambers suitable for footwear applications may be manufactured through various processes, including a two-film technique, thermoforming, and blowmolding. In the two-film technique, two planar sheets of polymer material are bonded together in various locations to form the chamber. In order to pressurize the chamber, a nozzle or needle connected to a fluid pressure source is inserted into a fill inlet formed in the chamber. Following pressurization, the fill inlet is sealed and the nozzle is removed. Thermoforming is similar to the two-film technique, but utilizes a heated mold that forms or otherwise shapes the sheets of polymer material during the manufacturing process. In blowmolding, a molten or otherwise softened elastomeric material in the shape of a tube (i.e., a parison) is placed in a mold having the desired overall shape and configuration of the chamber. The mold has an opening at one location through which pressurized air is provided. The pressurized air induces the liquefied elastomeric material to conform to the shape of the inner surfaces of the mold, thereby forming the chamber, which may then be pressurized.

SUMMARY

An article of footwear is disclosed below as having an upper and a sole structure secured to the upper. The sole structure includes a perimeter element and a central element, one or both of which may be a fluid-filled chamber. The perimeter element extends adjacent to a sidewall of the sole structure. The central element is centrally-positioned and at least partially spaced from the perimeter element to define a gap between the central element and the perimeter element. Various features may be incorporated into the sole structure. For example, the gap may have an upper portion and a lower portion, with the upper portion being located closer to the sidewall than the lower portion. As another example, the perimeter element may have a first compressibility and the central element may have a second compressibility, with the first compressibility being less than the second compressibility. When formed as fluid-filled chambers, the difference in compressibility may be due to differences in fluid pressure. As yet another example, the upper surface of the perimeter element may be at a greater elevation or higher than an upper surface of the central element.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various sole structure configurations for articles of footwear. Concepts related to the sole structure configurations are disclosed with reference to footwear that is suitable for running. The sole structure configurations are not limited to footwear designed for running, however, and may be utilized with a wide range of athletic footwear styles, including basketball shoes, cross-training shoes, cycling shoes, football shoes, soccer shoes, tennis shoes, and walking shoes, for example. The sole structure configurations may also be utilized with footwear styles that are generally considered to be non-athletic, including dress shoes, loafers, sandals, and boots. The concepts disclosed herein may, therefore, apply to a wide variety of footwear styles, in addition to the specific style discussed in the following material and depicted in the accompanying figures.

General Footwear Structure

Figure 1:
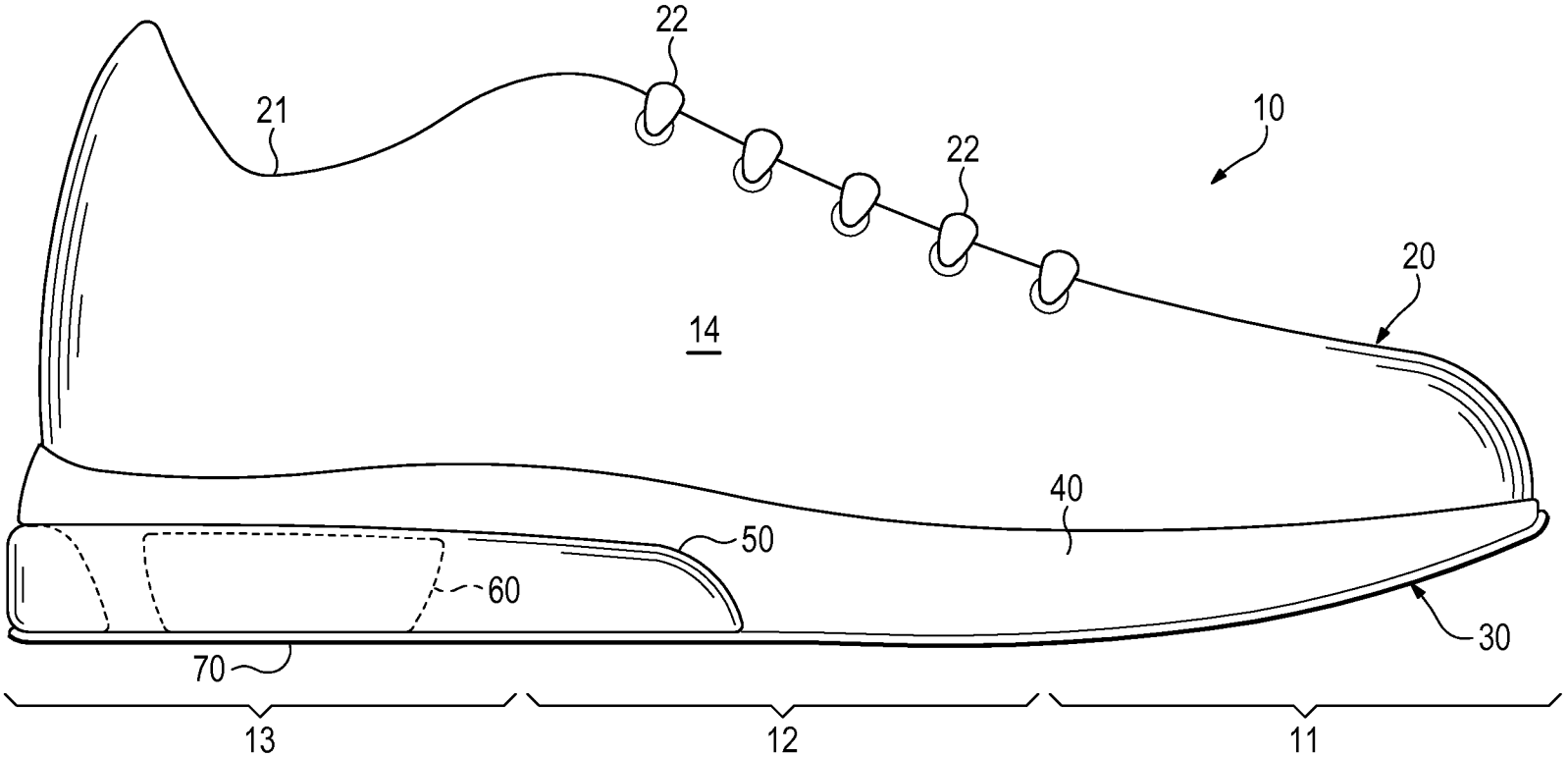
FIG. 1 is lateral side elevational view of an article of footwear.
Figure 2:
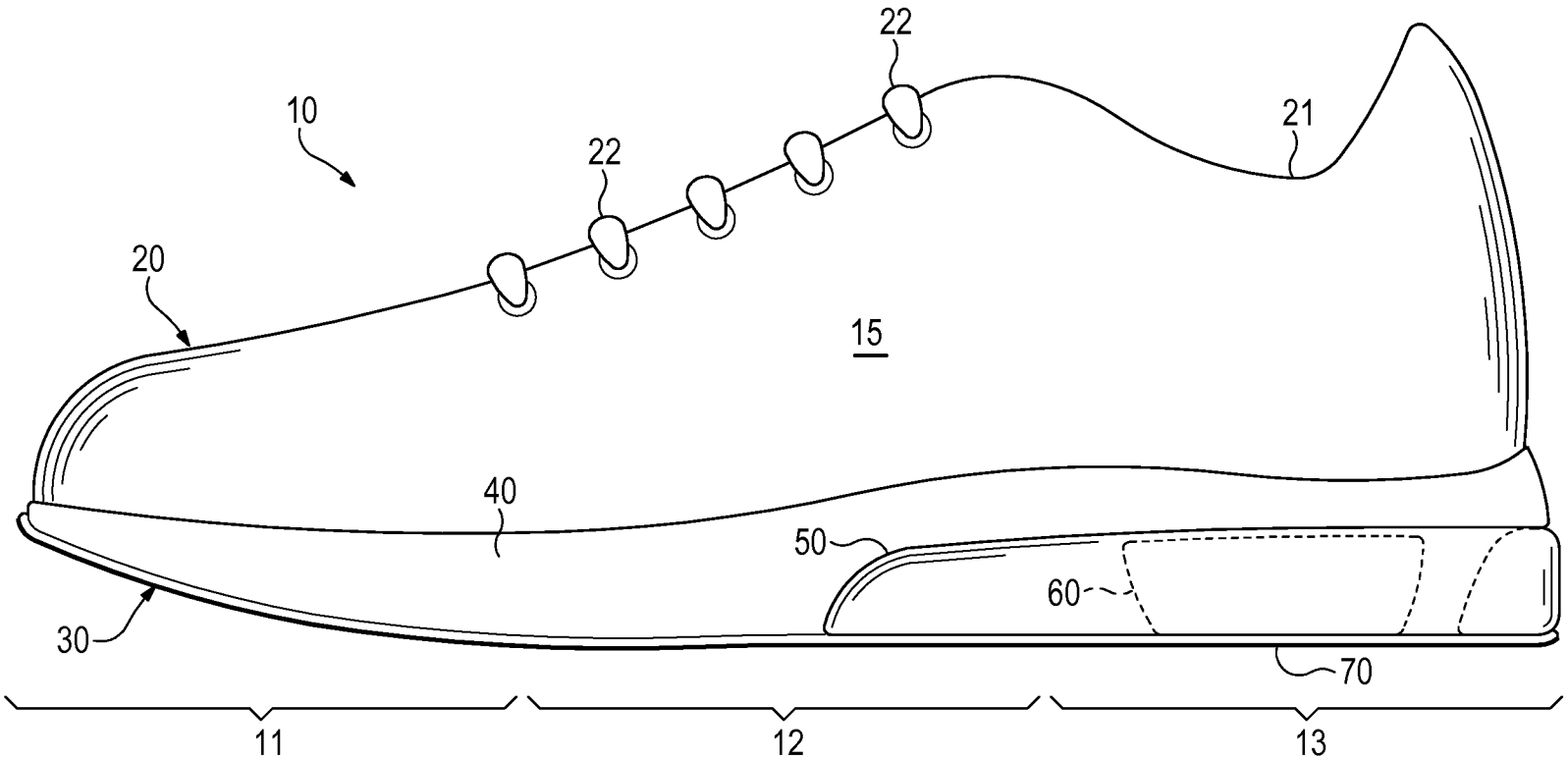
FIG. 2 is a medial side elevational view of the article of footwear.
Figure 3:
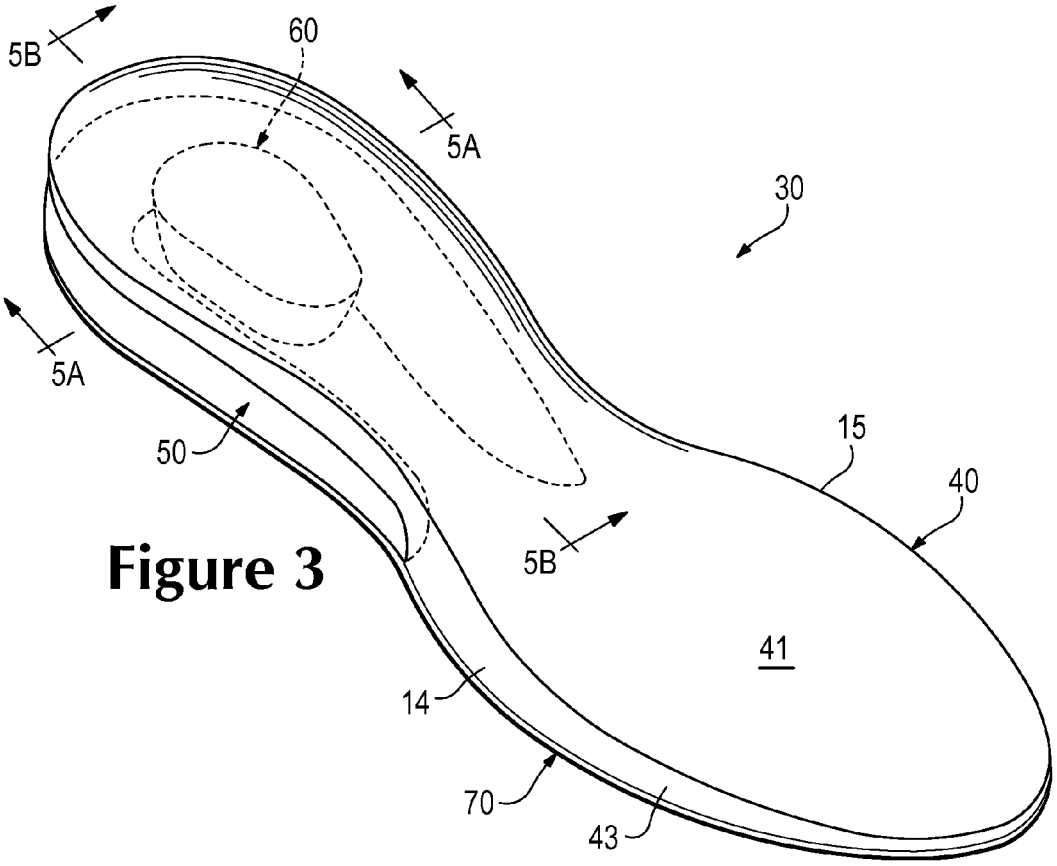
FIG. 3 is a perspective view of a sole structure of the article of footwear.
Figure 4:
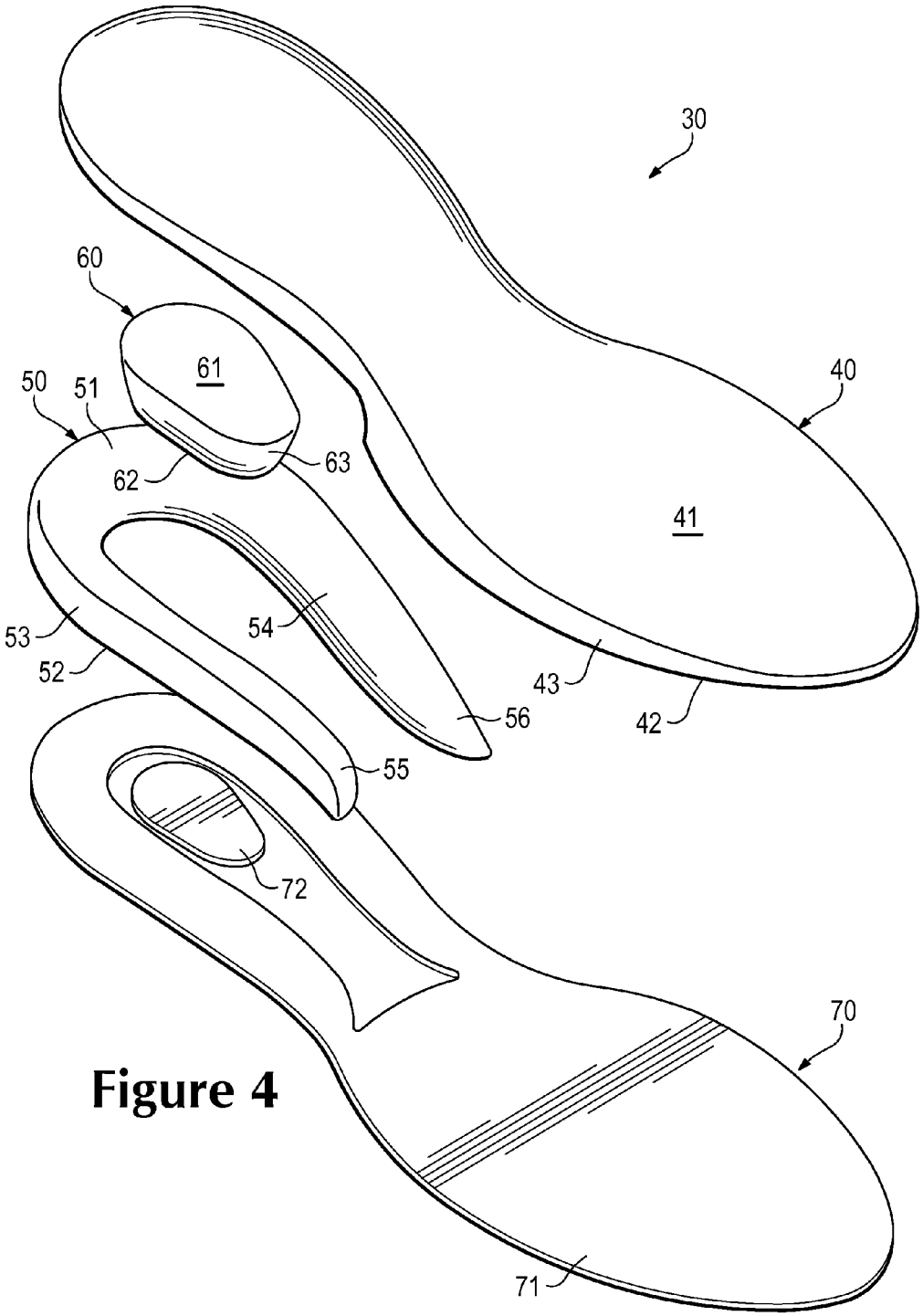
FIG. 4 is an exploded perspective view of the sole structure.

An article of footwear 10 is depicted in FIGS. 1 and 2 as including an upper 20 and a sole structure 30. For reference purposes, footwear 10 may be divided into three general regions: a forefoot region 11, a midfoot region 12, and a heel region 13, as shown in FIGS. 1 and 2. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to upper 20, sole structure 30, and individual elements thereof.

Upper 20 is depicted as having a substantially conventional configuration incorporating a plurality material elements (e.g., textiles, foam, leather, and synthetic leather) that are stitched or adhesively bonded together to form an interior void for securely and comfortably receiving a foot. The material elements may be selected and located with respect to upper 20 in order to selectively impart properties of durability, air-permeability, wear-resistance, flexibility, and comfort, for example. An ankle opening 21 in heel region 13 provides access to the interior void. In addition, upper 20 may include a lace 22 that is utilized in a conventional manner to modify the dimensions of the interior void, thereby securing the foot within the interior void and facilitating entry and removal of the foot from the interior void. Lace 22 may extend through apertures in upper 20, and a tongue portion of upper 20 may extend between the interior void and lace 22. Given that various aspects of the present discussion primarily relate to sole structure 30, upper 20 may exhibit the general configuration discussed above or the general configuration of practically any other conventional or non-conventional upper. Accordingly, the structure of upper 20 may vary significantly within the scope of the present invention.

Sole structure 30 is secured to upper 20 and has a configuration that extends between upper 20 and the ground. In general, the various elements of sole structure 30 attenuate ground reaction forces (i.e., imparts cushioning), affect the overall motion of the foot, and impart traction during walking, running, or other ambulatory activities. Additional details concerning the configuration of sole structure 30 will be described below.

Sole Structure Configuration

Sole structure 30 is depicted in FIGS. 3-5B and includes a midsole element 40, a perimeter chamber 50, a central chamber 60, and an outsole 70. In addition to these elements, sole structure 30 may incorporate one or more plates, moderators, or reinforcing structures, for example, that further enhance the ground reaction force attenuation characteristics of sole structure 30 or the performance properties of footwear 10. Additionally, sole structure 30 may incorporate a sockliner (not depicted) that is located within a lower portion of the void in upper 20 to enhance the comfort of footwear 10.

Midsole element 40 extends throughout a length of footwear 10 (i.e., through each of regions 11-13) and a width of footwear 10 (i.e., between sides 14 and 15). The primary surfaces of midsole element 40 are an upper surface 41, an opposite lower surface 42, and a side surface 43 that extends between surfaces 41 and 42. Upper surface 41 is joined to a lower area of upper 20, thereby joining sole structure 30 to upper 20. Lower surface 42 is joined with outsole 70 in forefoot region 11 and portions of midfoot region 12, but is secured to each of perimeter chamber 50 and central chamber 60 in at least heel region 13. Additionally, side surface 43 forms a portion of an exposed sidewall of sole structure 30 on both lateral side 14 and medial side 15.

A variety of materials may be utilized to form midsole element 40. As an example, midsole element 40 may be formed from a polymer foam material, such as polyurethane or ethylvinylacetate, that enhances the ground reaction force attenuation characteristics of sole structure 30 during walking, running, or other ambulatory activities. In some configurations, midsole element 40 may also be (a) a plate formed from a semi-rigid polymer material or (b) a combination of a plate and foam material. In addition to the foam material, midsole element 40 may incorporate one or more plates, moderators, or reinforcing structures, for example, that further enhance the ground reaction force attenuation characteristics of sole structure 30 or the overall performance properties of footwear 10. In further configurations, midsole element 40 may also encapsulate a fluid-filled chamber in forefoot region 11. Accordingly, the materials and overall configuration of midsole element 40 may vary significantly.

Perimeter chamber 50 and central chamber 60 are shown together and in a proper spatial relationship in FIGS. 6-10B. Each of chambers 50 and 60 enclose fluids (i.e., either a gas, liquid, or gel) and may be pressurized. In general, perimeter chamber 50 is located at a perimeter of sole structure 30, whereas central chamber 60 is located within a central area of sole structure 30. Although chambers 50 and 60 may contact each other or may be formed as a single unit in some configurations of footwear 10, a gap 31 generally extends between portions of chambers 50 and 60. As discussed in greater detail below, an upper portion 32 of gap 31 is located closer to the sidewall of sole structure 30 than a lower portion 33 of gap 31. That is, gap 31 extends in a generally diagonal direction such that lower portion 33 is located closer to a center of sole structure 30 than upper portion 32.

Perimeter chamber 50 has a generally U-shaped configuration. The exterior of perimeter chamber 50 defines an upper surface 51, an opposite lower surface 52, an exterior side surface 53 that extends between one side of surfaces 51 and 52, and an interior side surface 54 that extends between an opposite side of surfaces 51 and 52. Additionally, perimeter chamber 50 has a lateral portion 55 located adjacent to lateral side 14 and an opposite medial portion 56 located adjacent to medial side 15. When incorporated into sole structure 30, upper surface 51 is secured to lower surface 42 of midsole element 40, and lower surface 52 is secured to outsole 70. Although lateral portion 55 and medial portion 56 may have the same length and general dimensions (i.e., shape, height, thickness), the length and dimensions of lateral portion 55 and medial portion 56 may be different to vary the properties of sole structure 30 on sides 14 and 15. In some configurations, perimeter chamber 50 may also have various indentations or flex grooves that assist with enhancing the flexibility of sole structure 30 in specific areas.

Areas of perimeter chamber 50 extends around or adjacent to at least a portion of the perimeter of sole structure 30. More particularly, each of lateral portion 55 and medial portion 56 are exposed on the exterior of footwear 10. In this configuration, exterior side surface 53 extends along or adjacent to lateral side 14, extends around a rear area of heel region 13, and extends along or adjacent to medial side 15, thereby forming a portion of an exposed sidewall of sole structure 30 on lateral side 14 and medial side 15. In further configurations, however, perimeter chamber 50 may be spaced inward from the sidewall or may protrude outward significantly from the sidewall. Furthermore, although perimeter chamber 50 is depicted as extending into a portion of midfoot region 12, perimeter chamber 50 may be limited to heel region 13 or may extend throughout each of regions 11-13.

Central chamber 60 has a generally rounded configuration. The exterior of central chamber 60 defines an upper surface 61, an opposite lower surface 62, and a side surface 63. In general, central chamber 60 has a configuration wherein upper surface 61 has a greater area than lower surface 62, thereby causing side surface 63 to taper inward between surfaces 61 and 62. Moreover, upper surface 61 may have a shape that includes two rounded ends having different sizes. As such, central chamber 60 exhibits a general configuration of a fluid-filled bladder disclosed in U.S. Pat. No. 6,796,056 to Swigart, which is incorporated herein by reference. Within sole structure 30, upper surface 61 is secured to lower surface 42 of midsole element 40, and lower surface 62 is secured to outsole 70.

Central chamber 60 is located within the central area of sole structure 30, thereby being positioned between lateral portion 55 and medial portion 56 of perimeter chamber 50. At least a portion of central chamber 60 is spaced from perimeter chamber 50 to define gap 31 between central chamber 60 and perimeter chamber 50. Although chambers 50 and 60 may contact each other or may be formed as a single unit in some configurations of footwear 10, gap 31 generally extends between portions of chambers 50 and 60. For example, gap 31 may extend between at least central chamber 60 and areas of interior side surface 54 in lateral portion 55 and medial portion 56.

Figure 5A:
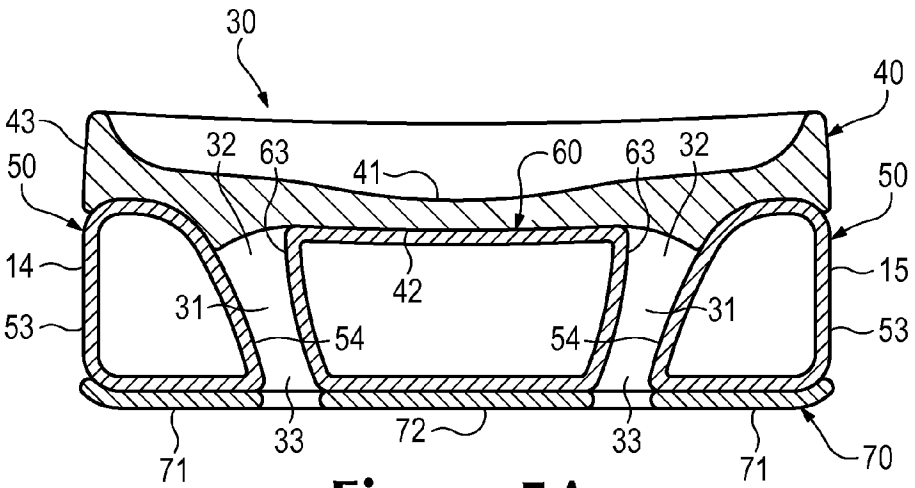
FIGS. 5A and 5B are cross-sectional views of the sole structure, as defined by section lines 5A and 5B in FIG. 3.
Figure 5B:
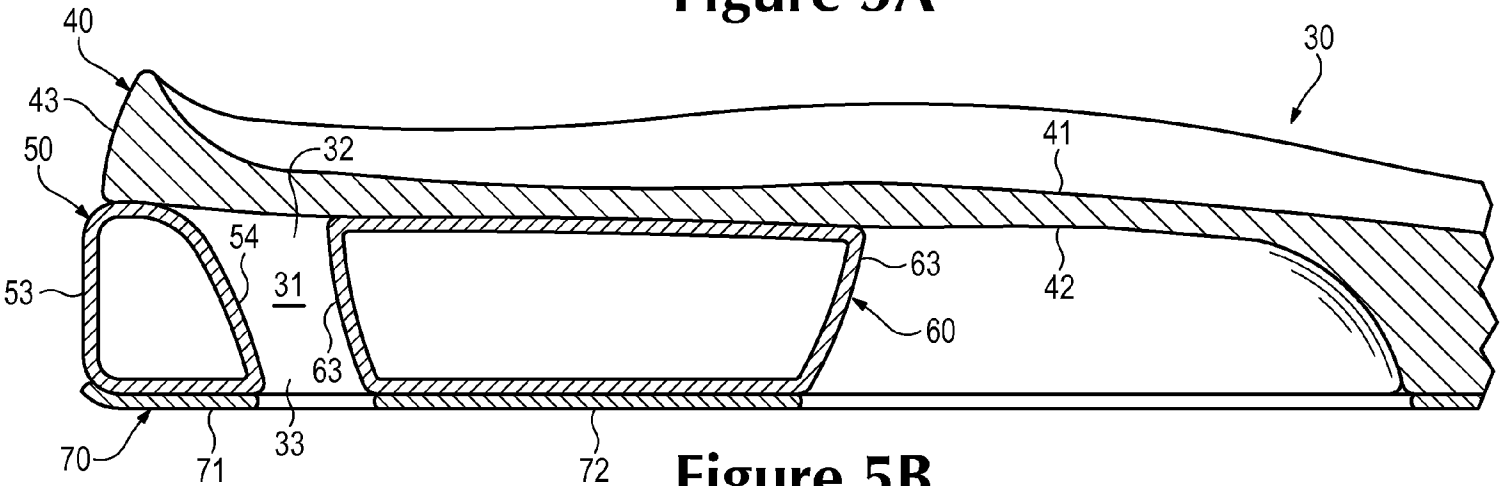
Figure 6:
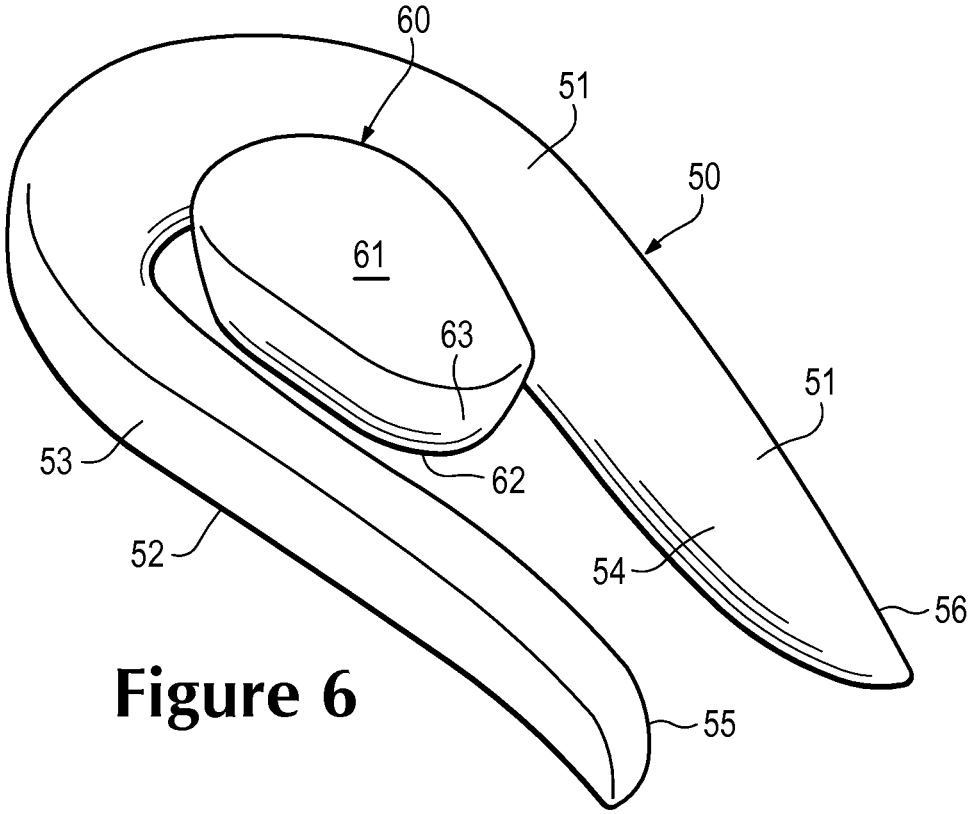
FIG. 6 is a perspective view of a perimeter chamber and a central chamber of the sole structure.
Figure 7:
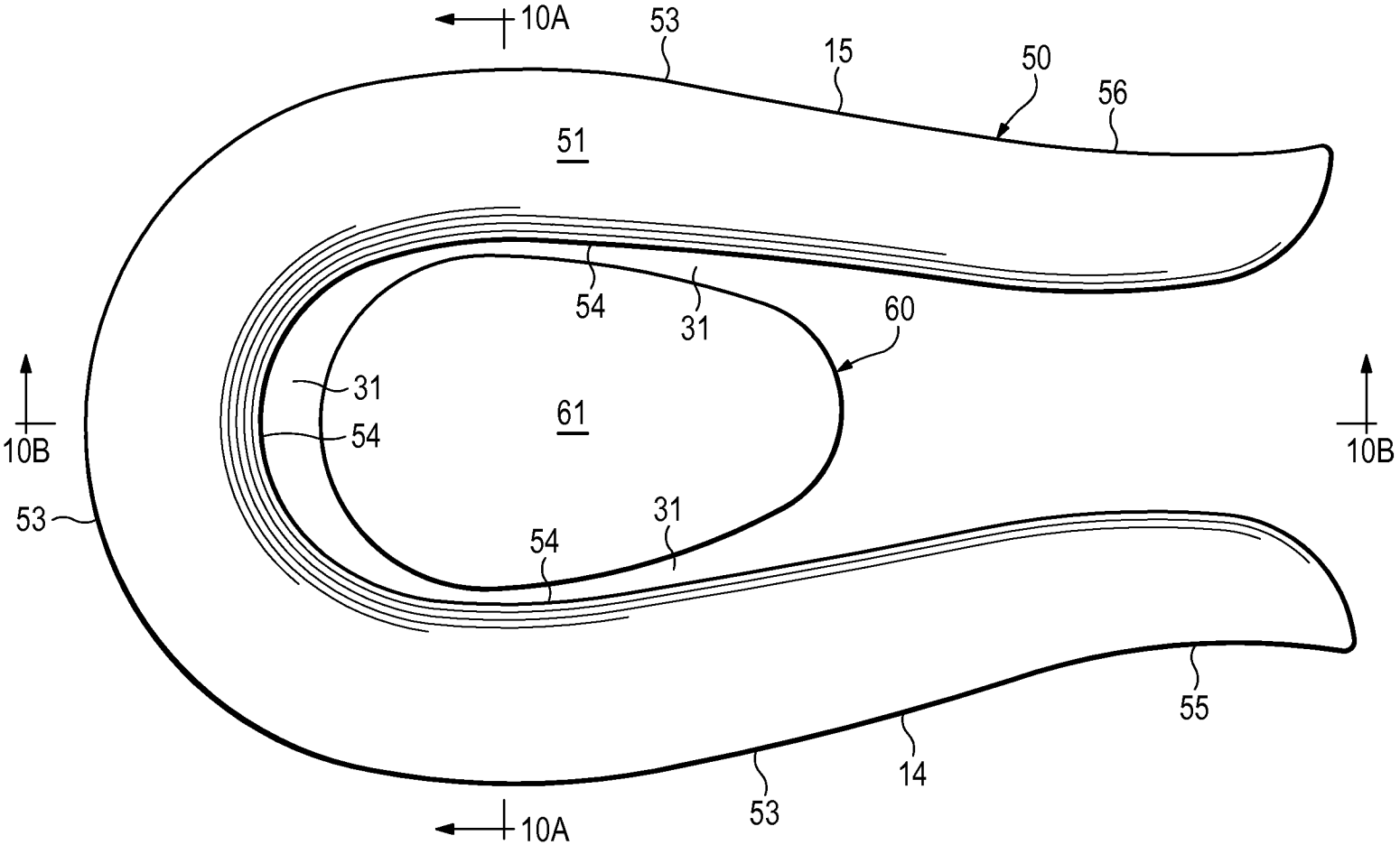
FIG. 7 is a top plan view of the perimeter chamber and the central chamber.
Figure 8:
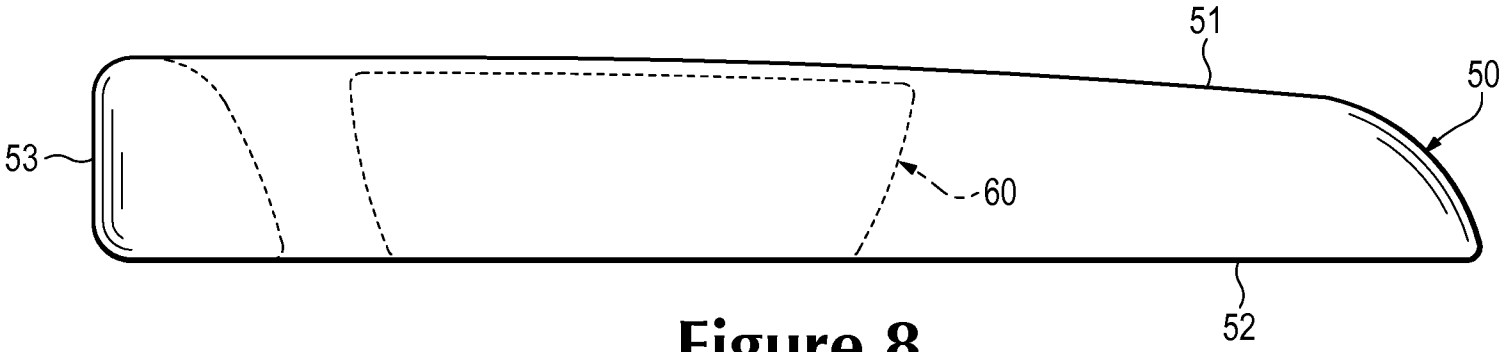
FIG. 8 is a side elevational view of the perimeter chamber and the central chamber.
Figure 9:
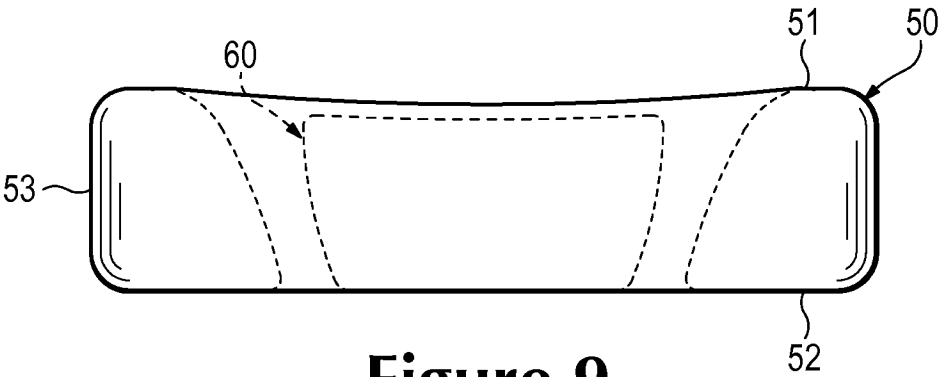
FIG. 9 is a rear elevational view of the perimeter chamber and the central chamber.
Figure 10A:
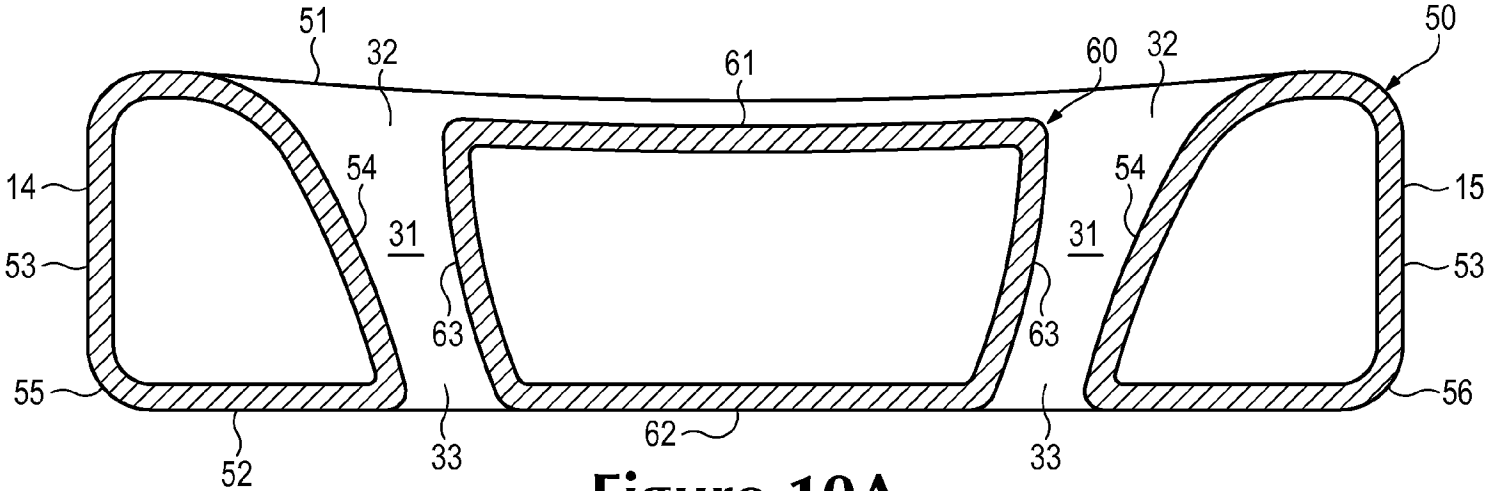
FIGS. 10A and 10B are cross-sectional views of the perimeter chamber and the central chamber, as defined by section lines 10A and 10B in FIG. 7.
Figure 10B:
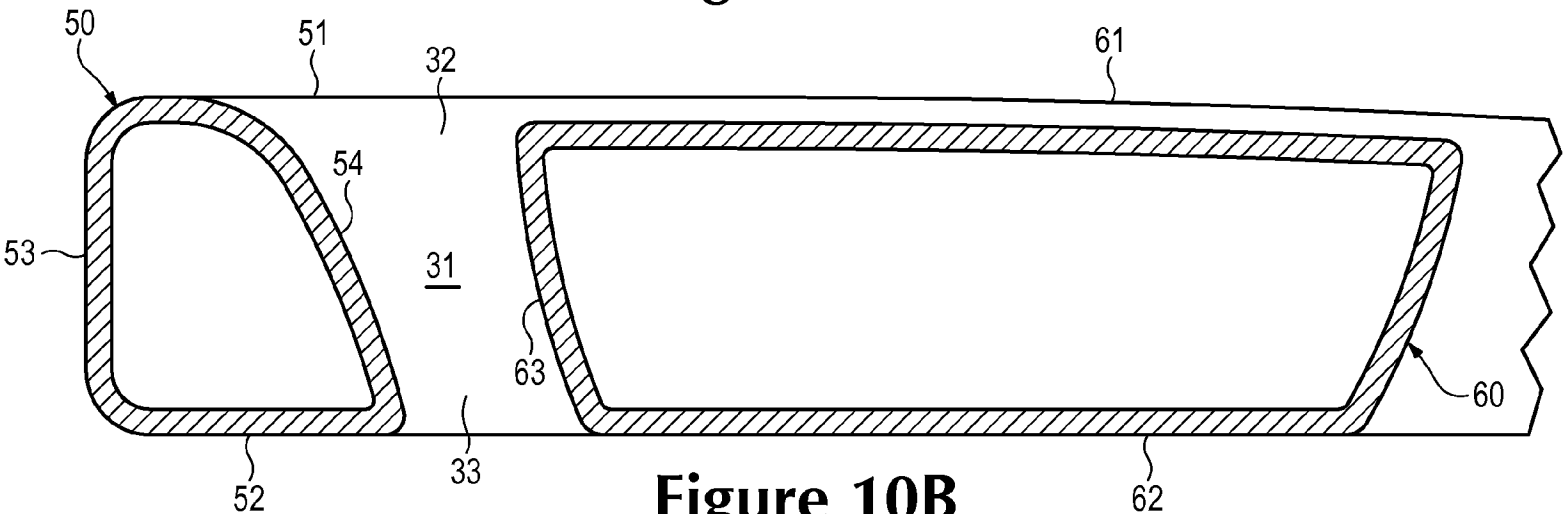

The relative elevations of perimeter chamber 50 and central chamber 60, as well as the configuration of midsole element 40, may form a depression that receives and seats the heel area of the foot. Referring to FIGS. 5A and 5B, for example, upper surfaces 41 of midsole element 40 forms a depression in sole structure 30, and the relative elevations of upper surfaces 51 and 61 correspond with the depression. More particularly, upper surface 51 of perimeter chamber 50 is above or located as a higher elevation than upper surface 61 of central chamber 60. In this configuration, the heel of the foot is seated within sole structure 30, which may enhance the overall stability of footwear 10 during walking, running, or other ambulatory activities.

A wide range of polymer materials may be utilized for chambers 50 and 60. In selecting materials for chambers 50 and 60, engineering properties of the materials (e.g., tensile strength, stretch properties, fatigue characteristics, dynamic modulus, and loss tangent) as well as the ability of the materials to prevent the diffusion of the fluid contained by chambers 50 and 60 may be considered. When formed of thermoplastic urethane, for example, the outer barrier of chambers 50 and 60 may have a thickness of approximately 1.0 millimeter, but the thickness may range from 0.25 to 2.0 millimeters or more, for example. In addition to thermoplastic urethane, examples of polymer materials that may be suitable for chambers 50 and 60 include polyurethane, polyester, polyester polyurethane, and polyether polyurethane. Chambers 50 and 60 may also be formed from a material that includes alternating layers of thermoplastic polyurethane and ethylene-vinyl alcohol copolymer, as disclosed in U.S. Pat. Nos. 5,713,141 and 5,952,065 to Mitchell, et al. A variation upon this material may also be utilized, wherein a center layer is formed of ethylene-vinyl alcohol copolymer, layers adjacent to the center layer are formed of thermoplastic polyurethane, and outer layers are formed of a regrind material of thermoplastic polyurethane and ethylene-vinyl alcohol copolymer. Another suitable material for chambers 50 and 60 is a flexible microlayer membrane that includes alternating layers of a gas barrier material and an elastomeric material, as disclosed in U.S. Pat. Nos. 6,082,025 and 6,127,026 to Bonk, et al. Additional suitable materials are disclosed in U.S. Pat. Nos. 4,183,156 and 4,219,945 to Rudy. Further suitable materials include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340; 6,203,868; and 6,321,465 to Bonk, et al.

The polymer materials forming the exteriors or outer barriers of chambers 50 and 60 enclose a fluid pressurized between zero and three-hundred-fifty kilopascals (i.e., approximately fifty-one pounds per square inch) or more. In addition to air and nitrogen, the fluids contained by chambers 50 and 60 may include octafluorapropane or be any of the gasses disclosed in U.S. Pat. No. 4,340,626 to Rudy, such as hexafluoroethane and sulfur hexafluoride, for example. In some configurations, either or both of chambers 50 and 60 may incorporate a valve that permits adjustment in the pressures of the fluids. Although the pressures of the fluids within chambers 50 and 60 may be the same, a difference in the pressures may be more than 70 kilopascals (i.e., approximately 10 pounds per square inch) in some configurations. For example, the pressure within perimeter chamber 50 may be at least 103.5 kilopascals (i.e., approximately 15 pounds per square inch) above an ambient pressure of air surrounding footwear 10, and the pressure within central chamber 60 may be less than 34.5 kilopascals (approximately 5 pounds per square inch) above the ambient pressure of the air surrounding footwear 10. Although the pressure within perimeter chamber 50 may be greater than the pressure within central chamber 60, the pressures may be equal or the pressure within perimeter chamber 50 may be less than the pressure within central chamber 60.

As discussed above, sole structure 30 may form a depression that receives and seats the heel area of the foot, which is at least partially caused by the relative elevations of upper surfaces 51 and 61, to enhance the overall stability of footwear 10. A further factor that may enhance stability relates to the relative pressures within chambers 50 and 60. Given that perimeter chamber 50 may be pressurized more than central chamber 60, perimeter chamber 50 may be less compressible than central chamber 60. In this configuration, the central area of sole structure 30, which includes central chamber 60, may compress more easily than the peripheral area, which includes perimeter chamber 50. The difference in pressures between chambers 50 and 60 may, therefore, further seat the heel of the foot within sole structure 30, which may further enhance the overall stability of footwear 10 during walking, running, or other ambulatory activities.

Outsole 70 forms a ground-contacting element of footwear 10 and may be formed from a durable and wear-resistant rubber material that includes texturing to impart traction. Outsole 70, which may be absent in some configurations of footwear 10, includes a perimeter section 71 and a central section 72. Perimeter section 71 is secured below perimeter chamber 50, and central section 72 is secured below central chamber 60. More particularly, perimeter section 71 may be secured directly to lower surface 52 of perimeter chamber 50, and central section 72 may be secured directly to lower surface 62 of central chamber 60. Although sections 71 and 72 may be joined in some configurations, sections 71 and 72 are depicted as being separate and spaced elements of outsole 70. When formed as separate and spaced sections of outsole 70, sections 71 and 72 may move independently of each other as chambers 50 and 60 are compressed or otherwise deformed during ambulatory activities.

Gap 31 generally extends between portions of chambers 50 and 60 and through outsole 70. In other words, gap 31 extends upward and into sole structure 30 from a lower surface of outsole 70. Although gap 31 may have a vertical orientation, upper portion 32 of gap 31 is located closer to the sidewall of sole structure 30 than lower portion 33 of gap 31. That is, gap 31 extends in a generally diagonal direction such that lower portion 33 is located closer to a center of sole structure 30 than upper portion 32. In order to impart the diagonal orientation to gap 31, interior side surface 54 of perimeter chamber 50 is sloped and extends toward the central area of sole structure 30, and side surface 63 of central chamber 60 is also sloped toward the central area. More particularly, interior side surface 54 tapers outward between upper surface 51 and lower surface 52, and side surface 63 tapers inward between upper surface 61 and lower surface 62.

Figure 11A:
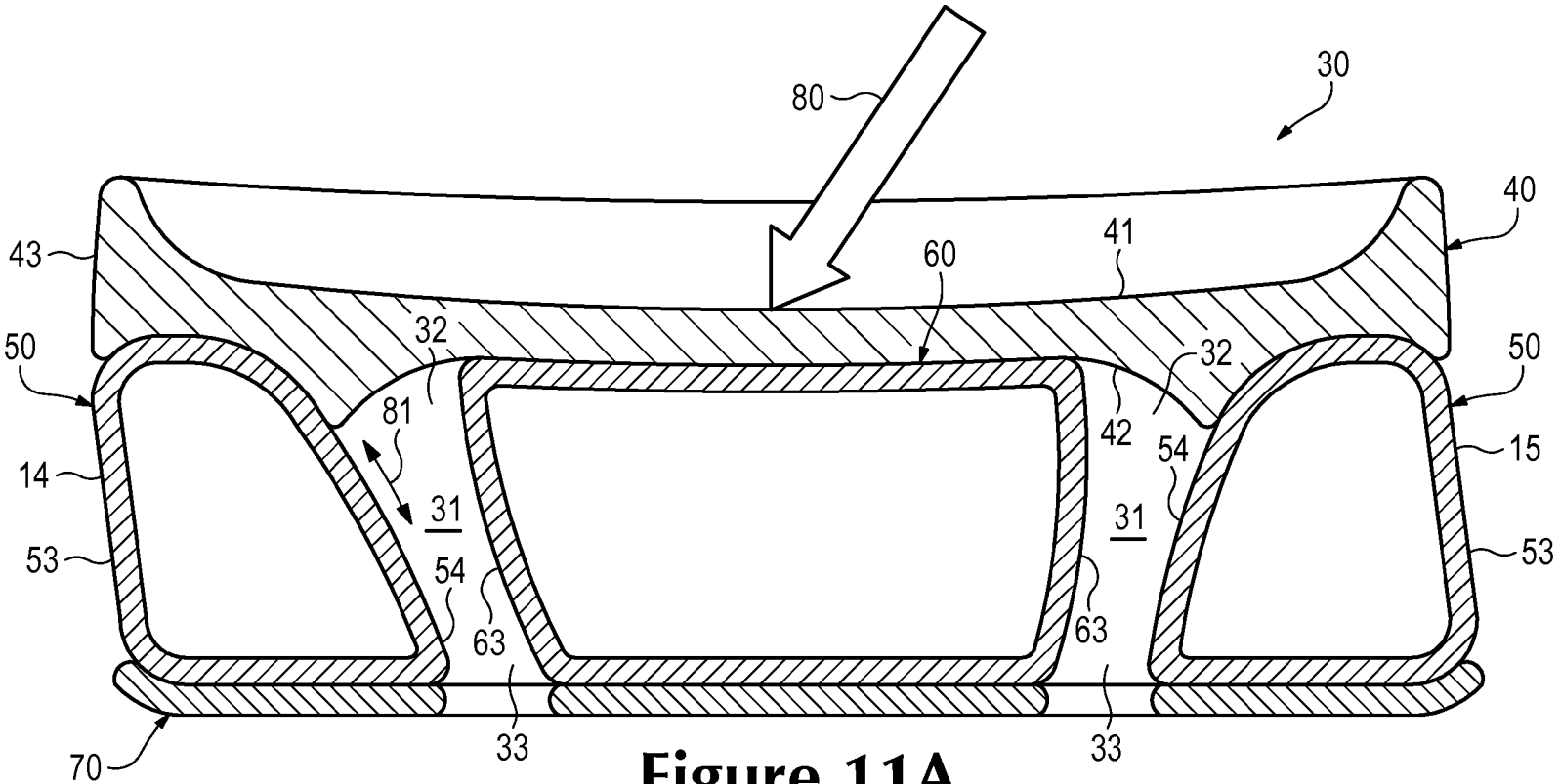
FIGS. 11A and 11B are cross-sectional views corresponding with FIG. 5A and depicting the sole structure when subjected to a compressive force.
Figure 11B:
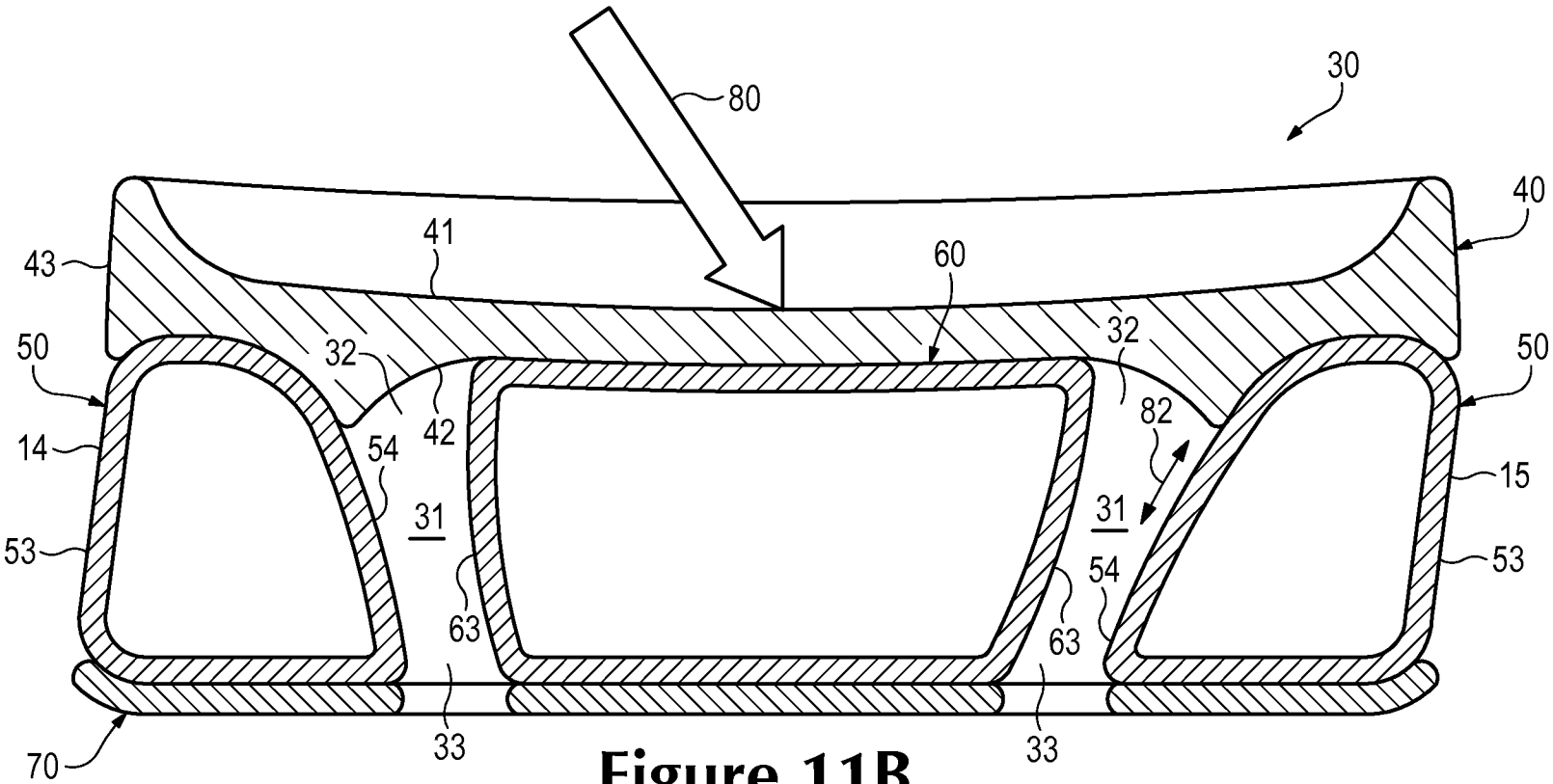

An advantage of the diagonal orientation of gap 31 relates to the stability of footwear 10. Referring to FIG. 11A, a force 80 is shown as compressing sole structure 30 and thrusting toward lateral side 14, which may correspond to a cutting motion that is utilized in many athletic activities to move an individual side-to-side. When force 80 deforms sole structure 30 in this manner, the sloping aspect of interior side surface 54 is placed in tension, as represented by arrow 81. The tension in interior side surface 54 resists the deformation of sole structure 30, thereby resisting the collapse of lateral side 14. Similarly, referring to FIG. 11B, force 80 is shown as compressing sole structure 30 and thrusting toward medial side 15, which may correspond to a pronation motion that occurs during running, for example. When force 80 deforms sole structure 30 in this manner, the sloping aspect of interior side surface 54 is placed in tension, as represented by arrow 82. The tension in interior side surface 54 resists the deformation of sole structure 30, thereby resisting the collapse of medial side 15. The diagonal orientation of gap 31, which is partially due to the slope in interior side surface 54, resists deformation in sole structure 30, thereby enhancing the overall stability of footwear 10 during walking, running, or other ambulatory activities.

Based upon the above discussion, many features of sole structure 30 enhance the overall stability of footwear 10. More particularly, the stability of footwear 10 is enhanced by (a) the depression in sole structure 30 from the relative elevations of upper surfaces 51 and 61 of chambers 50 and 60, (b) the different compressibilities of chambers 50 and 60 from the different pressures of fluids within chambers 50 and 60, and (c) the diagonal orientation of gap 31 from the slope in interior side surface 54 of perimeter chamber 50. While any of these features may be utilized independently to enhance stability, incorporating two or more of the features into sole structure 30 has an advantage of further enhancing the overall stability of footwear 10.

Further Configurations

Figure 12A:
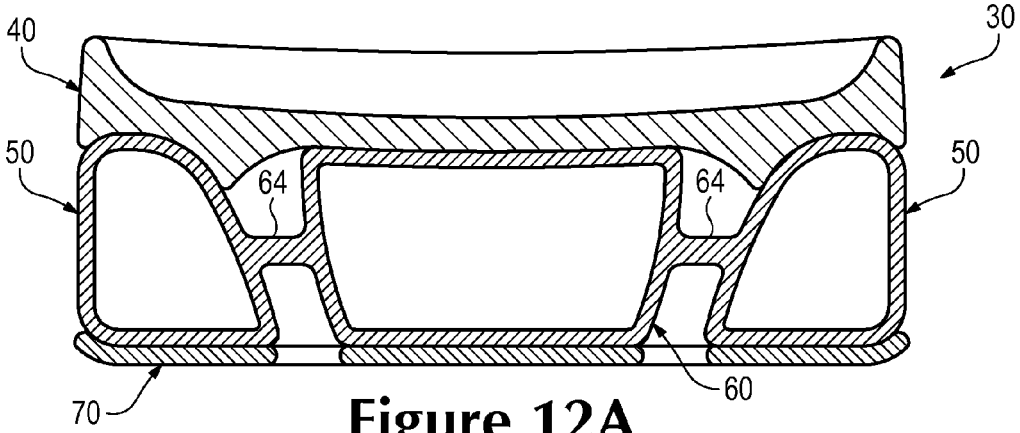
FIGS. 12A-12F are cross-sectional views corresponding with FIG. 5A and depicting further configurations of the sole structure.
Figure 12B:
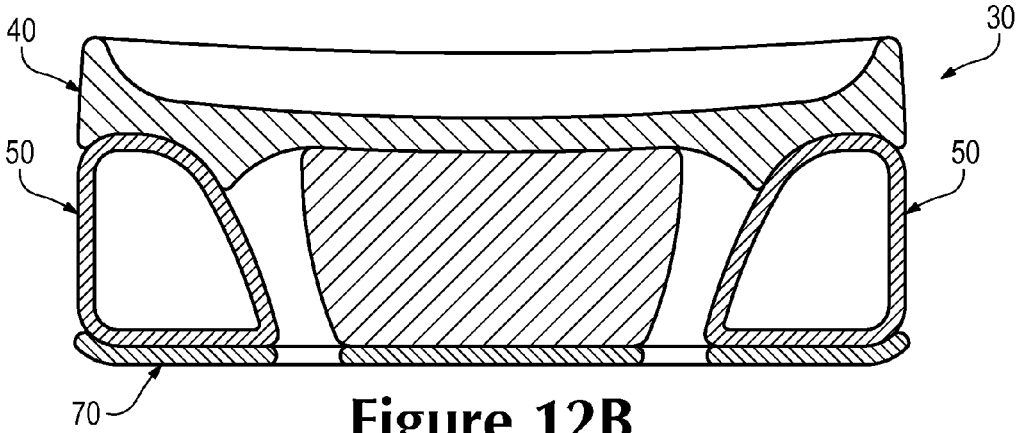
Figure 12C:
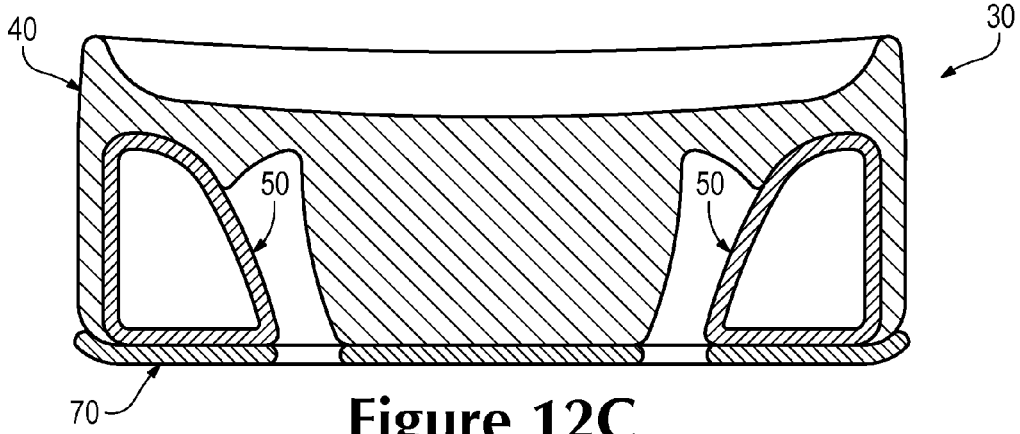
Figure 12D:
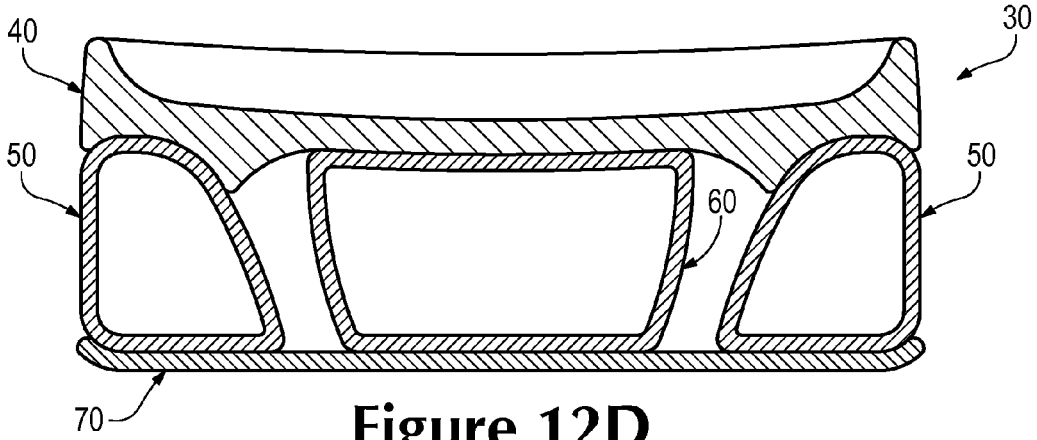
Figure 12E:
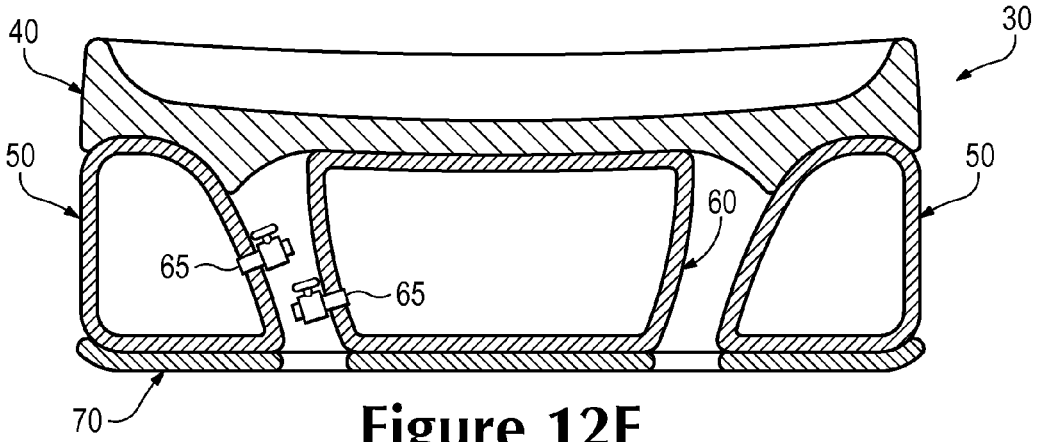
Figure 12F:
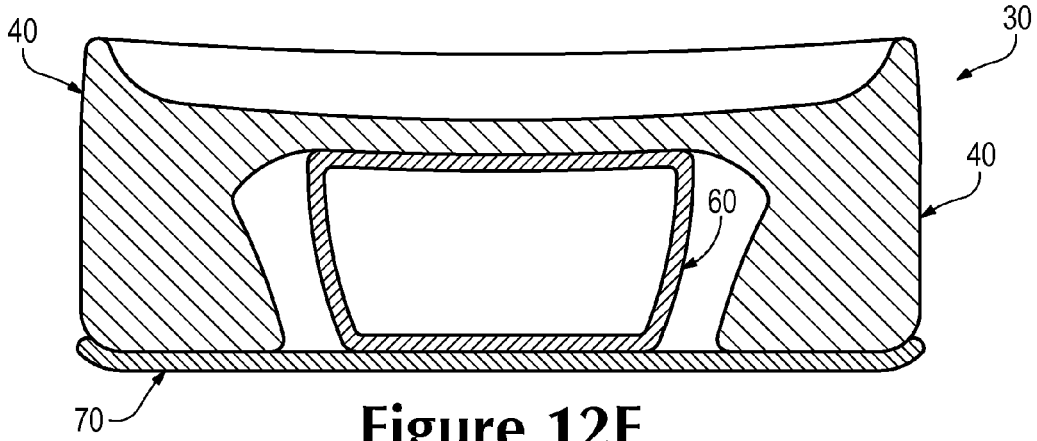

The configuration sole structure 30 discussed above and depicted in the figures provides one example of a suitable configuration for footwear 10. A variety of other configurations, having different features, may also be utilized. Referring to FIG. 12A, for example, chambers 50 and 60 are depicted as being interconnected by tie elements 64. When chambers 50 and 60 are formed to have a one-piece configuration, for example, tie elements 64 may be a web of polymer material that joins chambers 50 and 60 during the manufacturing process. In some configurations, tie elements 64 may also include conduits that allow fluid to pass between chambers 50 and 60. Referring to FIG. 12B, central chamber 60 is depicted as having a solid configuration and may, for example, be a foam element located within the central area of sole structure 30. Central chamber 60 may also be a foam-filled or foam-and-fluid-filled chamber in some configurations. Moreover, perimeter chamber 50 may have a similar solid configuration. Referring to FIG. 12C, sole structure 30 has a configuration wherein midsole element 40 extends over sides of perimeter chamber 50 and also replaces central chamber 60. Referring to FIG. 12D, outsole 70 is formed to have a one-piece configuration that extends over gap 31. Although gap 31 may extend upward and into sole structure 30, outsole 70 may cover gap 31 in some configurations. As another example, FIG. 12E depicts a configuration wherein a pair of valves 65 are associated with chambers 50 and 60, which may allow adjustment of the fluid pressures within chambers 50 and 60. Additionally, perimeter chamber 50 may also be a foam element, as depicted in FIG. 12F, as well as a foam-filled or foam-and-fluid-filled chamber.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. An article of footwear having an upper and a sole structure secured to the upper, the sole structure comprising:

a perimeter element extending adjacent to a sidewall of the sole structure on both a lateral side and a medial side of the footwear; and a central element positioned between the lateral side and the medial side, the central element being spaced from the perimeter element to define a gap between the central element and the perimeter element, wherein the exterior of the perimeter element defines an upper surface facing the upper, an opposite lower surface, and an interior side surface which slopes toward a center of the sole structure as the interior side surface of the perimeter element extends from the upper surface of the perimeter element to the lower surface of the perimeter element, wherein the central element is separate from the perimeter element, and wherein the central element defines an upper surface facing the upper, an opposite lower surface, and a side surface which slopes toward a center of the sole structure as the side surface of the central element extends from the upper surface of the central element to the lower surface of the central element.

2. The article of footwear of claim 1, wherein the perimeter element has a first compressibility and the central element has a second compressibility, the first compressibility being less than the second compressibility.

3. The article of footwear of claim 1, wherein at least one of the perimeter element and the central element is a fluid-filled chamber.

4. The article of footwear of claim 1, wherein the perimeter element encloses a fluid with a first pressure and the central element encloses a fluid with a second pressure, the first pressure being greater than the second pressure.

5. The article of footwear of claim 4, wherein the first pressure is at least 103.5 kilopascals above an ambient pressure of air surrounding the footwear, and the second pressure is less than 34.5 kilopascals above the ambient pressure of the air surrounding the footwear.

6. The article of footwear of claim 1, wherein a difference between the first pressure and the second pressure is at least 70 kilopascals.

7. The article of footwear of claim 1, wherein a bottom surface of the central element faces the ground engaging surface of the sole structure;

wherein the top surface of the central element has a greater area than the bottom surface of the central element.

8. The article of footwear of claim 1, wherein the top surface of the central element is larger than the bottom surface of the central element when the central element is not subjected to a compressive force.

9. The article of footwear of claim 1, wherein at least one of a foam element and a plate extend between the upper and each of the perimeter element and the central element.

10. The article of footwear of claim 1, wherein the top surface of the central element is located below an upper surface of the perimeter element.

11. The article of footwear of claim 1, wherein a side surface of the perimeter element is exposed at the sidewall of the sole structure.

12. An article of footwear having an upper and a sole structure secured to the upper, the sole structure comprising:

a perimeter chamber having a lateral portion and a medial portion, the lateral portion extending adjacent to a sidewall of the sole structure on a lateral side of the footwear, and the medial portion extending adjacent to the sidewall of the sole structure on a medial side of the footwear; and a central chamber positioned between the lateral portion and the medial portion of the perimeter chamber, the central chamber being spaced from the perimeter chamber to define a gap between the central chamber and each of the lateral portion and the medial portion, wherein the perimeter element includes an upper exterior surface, an lower exterior surface opposite the upper exterior surface, and a side surface extending between the upper exterior surface of the perimeter element and the lower exterior surface of the perimeter element and which is sloped such that a lower portion of the side surface of the perimeter element adjacent to the lower exterior surface of the perimeter element is closer to a center of the central chamber than an upper portion of the side surface of the perimeter element adjacent to the upper exterior surface of the perimeter element, wherein the gap between the central element and the perimeter element extends continuously around a lateral side of the central element, a rear side of the central element, and a medial side of the central element, wherein the central chamber defines an upper surface facing the upper, an opposite lower surface, and a side surface which slopes toward a center of the sole structure as the side surface of the central element extends from the upper surface of the central element to the lower surface of the central element, wherein the perimeter chamber encloses a fluid with a first pressure and the central chamber encloses a fluid with a second pressure, the first pressure being greater than the second pressure.

13. The article of footwear of claim 12, wherein each of the perimeter chamber and the central chamber tapers with respect to a direction extending between an upper portion of the sole structure and a lower portion of the sole structure.

14. The article of footwear of claim 13, wherein the central chamber tapers in a direction opposite to a direction the perimeter chamber tapers.

15. The article of footwear of claim 13, wherein the perimeter chamber tapers so that an upper portion of a sidewall of the perimeter chamber forming the gap is located closer to the sidewall of the sole structure than a lower portion of the sidewall of the perimeter chamber.

16. The article of footwear of claim 12, wherein a bottom surface of the central chamber faces the ground engaging surface of the sole structure;

wherein a top surface of the central chamber faces the upper and has a greater area than the bottom surface of the central chamber.

17. The article of footwear of claim 12, wherein the first pressure is at least 103.5 kilopascals above an ambient pressure of air surrounding the footwear, and the second pressure is less than 34.5 kilopascals above the ambient pressure of the air surrounding the footwear.

18. The article of footwear of claim 12, wherein a difference between the first pressure and the second pressure is at least 70 kilopascals.

19. The article of footwear of claim 12, wherein the perimeter chamber has a generally U-shaped configuration.

20. An article of footwear having an upper and a sole structure secured to the upper, the sole structure comprising:

a perimeter element extending adjacent to both a lateral side and a medial side of the footwear; and a central element positioned between the lateral side and the medial side, the central element being spaced from the perimeter element to define a gap oriented diagonally between the central element and the perimeter element, wherein all of the central element is spaced from the perimeter element, wherein the exterior of the perimeter element defines an upper surface, an opposite lower surface, and an interior side surface sloped toward a center of the sole structure as the interior side surface extends from the upper surface to the lower surface, and wherein a top surface of the central element facing the upper has a greater lateral width than a bottom surface of the central element facing the ground engaging surface of the sole structure.

21. The article of footwear of claim 20, wherein the central element is tapered so that a sidewall of the central element is angled with respect to a vertical direction extending between the ground engaging surface of the sole structure and the upper.

22. The article of footwear of claim 20, wherein the top surface of the central element is located below an upper surface of the perimeter element in a direction extending between the ground engaging surface of the sole structure and the upper.

23. The article of footwear of claim 20, wherein a side surface of the perimeter element is exposed at the sidewall of the sole structure.

24. The article of footwear of claim 20, wherein the gap provides an unconnected region between the perimeter element and the central element so that there is no connection between the perimeter element and the central element within the gap.

25. The article of footwear of claim 24, wherein the gap surrounds the central element.

* * * * *